US012179899B2

(12) United States Patent
Jaszewski et al.

(10) Patent No.: US 12,179,899 B2
(45) Date of Patent: Dec. 31, 2024

(54) MARINE DRIVE LOWER UNIT HAVING EXTENSION LEG

(71) Applicant: Brunswick Corporation, Mettawa, IL (US)

(72) Inventors: Wayne M. Jaszewski, West Bend, WI (US); John A. Groeschel, Theresa, WI (US)

(73) Assignee: Brunswick Corporation, Mettawa, IL (US)

( * ) Notice: Subject to any disclaimer, the term of this patent is extended or adjusted under 35 U.S.C. 154(b) by 477 days.

(21) Appl. No.: 17/550,463

(22) Filed: Dec. 14, 2021

(65) Prior Publication Data

US 2023/0182880 A1 Jun. 15, 2023

(51) Int. Cl.

| | |
|---|---|
| ***B63H 20/34*** | (2006.01) |
| ***B63H 20/32*** | (2006.01) |
| ***B63H 21/17*** | (2006.01) |

(52) U.S. Cl.

CPC ..... *B63H 20/34* (2013.01); *B63H 21/17* (2013.01); *B63H 2020/323* (2013.01)

(58) Field of Classification Search

CPC .. B63H 20/34; B63H 21/17; B63H 2020/323; B63H 2005/075; B63H 2005/1258; B63H 20/007; B63H 20/06; B63H 20/10

See application file for complete search history.

(56) References Cited

U.S. PATENT DOCUMENTS

| | | | | |
|---|---|---|---|---|
| 1,764,388 | A * | 6/1930 | Buchet | B63H 23/24 310/87 |
| 2,247,671 | A | 7/1941 | Tepel | |
| 2,545,086 | A | 3/1951 | Harris | |
| 2,877,733 | A | 3/1959 | Harris | |
| 3,052,204 | A | 9/1962 | Scivally | |
| 4,066,032 | A | 1/1978 | Calvin | |
| 4,226,432 | A | 10/1980 | Nakamizo | |
| 4,267,401 | A | 5/1981 | Wilkinson | |

(Continued)

FOREIGN PATENT DOCUMENTS

| | | |
|---|---|---|
| DE | 102019213702 | 3/2021 |
| EP | 775630 | 5/1997 |
| FR | 2542518 | 3/1935 |

OTHER PUBLICATIONS

Declaration of Prior Art Submitted in Corresponding U.S. Appl. No. 17/671,041 on Feb. 14, 2022.

(Continued)

*Primary Examiner* — Anthony D Wiest

(74) *Attorney, Agent, or Firm* — Andrus Intellectual Property Law, LLP

(57) ABSTRACT

A marine drive has a supporting frame for coupling the marine drive to a marine vessel; a gearcase supporting a propulsor for propelling the marine vessel in water; an extension leg disposed between the supporting frame and the gearcase; and an adapter plate between the supporting frame and the extension leg. A tube is in the extension leg. The tube has a lower end which is coupled to the gearcase and upper end which is coupled to the adapter plate by a compression nut threaded onto the tube, wherein threading the compression nut down on the tube compressively engages the compression nut with the adapter plate, which in turn clamps the extension leg between the supporting frame and the gearcase.

16 Claims, 5 Drawing Sheets

(56) References Cited

U.S. PATENT DOCUMENTS

| | | | | |
|---|---|---|---|---|
| 4,632,487 | A | 12/1986 | Wargula | |
| 4,744,777 | A | 5/1988 | Ferguson | |
| 5,114,352 | A | 5/1992 | Gahagen et al. | |
| 5,197,910 | A | 3/1993 | Kanno et al. | |
| 5,235,138 | A | 8/1993 | Shah et al. | |
| 5,445,545 | A | 8/1995 | Draper | |
| 5,510,577 | A | 4/1996 | Corrigan | |
| 5,831,217 | A | 11/1998 | Jarvis et al. | |
| 6,521,840 | B1 | 2/2003 | Kreutz | |
| 6,923,134 | B1 | 8/2005 | Vrudny et al. | |
| 6,966,806 | B1 | 11/2005 | Bruestle et al. | |
| 7,435,147 | B1 | 10/2008 | Eichinger | |
| 7,452,251 | B2 | 11/2008 | Boebel | |
| 7,659,699 | B2 | 2/2010 | Boebel | |
| 8,043,135 | B1 * | 10/2011 | Corn | B63H 20/34 440/66 |
| 8,337,264 | B2 | 12/2012 | Boebel | |
| 8,529,305 | B2 | 9/2013 | Lin | |
| 8,628,091 | B2 | 1/2014 | Davidson | |
| 9,446,830 | B2 | 9/2016 | Hartmeyer et al. | |
| 9,481,435 | B1 | 11/2016 | Jaszewski et al. | |
| 9,490,619 | B2 | 11/2016 | Smith | |
| 9,630,694 | B1 | 4/2017 | Jaszewski | |
| 9,701,383 | B1 | 7/2017 | Stuber et al. | |
| 9,718,526 | B2 | 8/2017 | Biebach et al. | |
| 9,789,946 | B2 | 10/2017 | Biebach et al. | |
| 9,815,541 | B2 | 11/2017 | Biebach et al. | |
| 9,853,465 | B2 | 12/2017 | Biebach et al. | |
| 9,896,172 | B1 | 2/2018 | Pugh | |
| 9,963,213 | B1 | 5/2018 | Jaszewski et al. | |
| 10,096,863 | B2 | 10/2018 | Hartmeyer et al. | |
| 10,124,870 | B2 | 11/2018 | Bergmann et al. | |
| 10,263,361 | B1 | 4/2019 | Gretz | |
| 10,266,244 | B2 | 4/2019 | Bergmann et al. | |
| 10,343,759 | B2 | 7/2019 | Despineux | |
| 10,351,220 | B1 | 7/2019 | Witte et al. | |
| 10,384,757 | B2 | 8/2019 | Mueller et al. | |
| 10,421,363 | B2 | 9/2019 | Biebach | |
| 10,472,036 | B2 | 11/2019 | Spengler et al. | |
| 10,556,659 | B2 | 2/2020 | Biebach et al. | |
| 10,647,398 | B2 | 5/2020 | Biebach | |
| 10,862,087 | B2 | 12/2020 | Hartmeyer | |
| 10,926,853 | B2 | 2/2021 | Despineux et al. | |
| 10,981,637 | B1 | 4/2021 | Alby et al. | |
| 11,001,360 | B2 | 5/2021 | Basler | |
| 11,021,224 | B2 | 6/2021 | Biebach | |
| 11,040,761 | B2 | 6/2021 | Biebach et al. | |
| 11,066,141 | B2 | 7/2021 | Despineux et al. | |
| 11,091,241 | B2 | 8/2021 | Despineux et al. | |
| 11,155,322 | B2 | 10/2021 | Baros | |
| 11,572,145 | B1 | 2/2023 | Andrasko | |
| 11,866,137 | B1 | 1/2024 | Jaszewski | |
| 2009/0269994 | A1 | 10/2009 | Altson | |
| 2020/0017183 | A1 | 1/2020 | He et al. | |
| 2023/0257095 | A1 | 8/2023 | Waldvogel | |

OTHER PUBLICATIONS ePropulsion Brand Products found online at https://www.epropulsion.com/who-we-are/, accessed Feb. 9, 2022.

Fergus, et al. Unpublished U.S. Appl. No. 17/487,116, filed Sep. 28, 2021.

Schmidt, et al. Unpublished U.S. Appl. No. 17/585,214, filed Jan. 26, 2022.

Schrank, et al. Unpublished U.S. Appl. No. 17/509,739, filed Oct. 25, 2021.

Seta, et al. Unpublished U.S. Appl. No. 17/554,540, filed Dec. 17, 2021.

Extended European Search Report for EP Application No. 22202932.4, dated Mar. 24, 2023.

Extended European Search Report issued in corresponding EP Application No. 2220682938, dated May 15, 2023.

Unpublished U.S. Appl. No. 17/469,479 to Kass W. Sawyer filed Sep. 8, 2021.

Amphenol. Sell sheet for RADLOK product line. Document created Oct. 23, 2014.

Amphenol. Sell sheet for SurLok product line. Document created Oct. 23, 2014.

Extended European Search Report for EP Application No. 23154210.1, dated Jul. 19, 2023.

Office Action issued in U.S. Appl. No. 17/671,041 on Sep. 11, 2024.

* cited by examiner

MARINE DRIVE LOWER UNIT HAVING EXTENSION LEG

FIELD

The present disclosure relates to marine drives for propelling a marine vessel in water.

BACKGROUND

The following U.S. Patents are incorporated by reference in entirety.

U.S. Pat. No. 10,981,637 discloses an apparatus is for supporting an outboard motor on a transom of a marine vessel. The apparatus has a transom bracket configured for fixed attachment to the transom; a supporting cradle that supports the outboard motor with respect to the transom bracket, wherein the supporting cradle is pivotable with respect to the transom bracket about a trim axis; and a trim actuator that is pivotally coupled to the transom bracket at a first trim actuator pivot axis and to the supporting cradle at a second trim actuator pivot axis. Extension of the trim actuator pivots the supporting cradle upwardly about the trim axis. Retraction of the trim actuator pivots the supporting cradle downwardly about the trim axis. The trim axis is located aftwardly of the first trim actuator pivot axis.

U.S. Pat. No. 9,963,213 discloses a system for mounting an outboard motor propulsion unit to a marine vessel transom. The propulsion unit's midsection has an upper end supporting an engine system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

U.S. Pat. No. 9,481,435 discloses an assembly for mounting an outboard motor to a transom of a marine vessel. A support structure is configured to be coupled to the transom by a plurality of fasteners that extend through the support structure and through a set of holes that have been drilled in the transom. A steering head is coupled to the support structure and configured to support an outboard motor thereupon for rotation about a generally vertical steering axis. The set of holes is divided by a generally vertical fore-aft central plane, and the outboard motor extends along a generally vertical fore-aft central plane. The support structure and the steering head are coupled to one another such that the central plane of the outboard motor is capable of being laterally offset from the central plane of the set of holes. An assembly for mounting two or more outboard motors is also provided.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In examples disclosed herein, a marine drive comprises a supporting frame for coupling the marine drive to a marine vessel; a gearcase supporting a propulsor for propelling the marine vessel in water; an extension leg disposed between the supporting frame and the gearcase; and a tube in the extension leg, the tube having an upper end and a lower end, wherein the lower end is rigidly coupled to the gearcase. A compression nut directly or indirectly couples the upper end of the tube to the supporting frame, in particular so as to clamp the extension leg in place between the supporting frame and the gearcase.

In further non-limiting examples, the compression nut is engaged with the tube by a threaded connection such that rotating the compression nut relative to the tube in a first direction causes the compression nut to travel downwardly along the tube and such that rotating the compression nut relative to the tube in an opposite, second direction causes the compression nut to travel upwardly along the tube.

In further non-limiting examples, an adapter plate is disposed between the supporting frame and the extension leg, wherein the tube extends through the adapter plate, and wherein rotating the compression nut relative to the tube in the first direction moves the compression nut into compressing engagement with the adapter plate, which in turn clamps the extension leg between the adapter plate and the gearcase. Rotating the compression nut relative to the tube in the second direction moves the compression nut out of compressing engagement with the adapter plate, which in turn unclamps the extension leg relative to the adapter plate and the gearcase.

In further non-limiting examples, the adapter plate comprises an abutment surface disposed around the tube, wherein rotating the compression nut relative to the tube in the first direction moves the compression nut onto the abutment surface, which thereby clamps the extension leg between the adapter plate and the gearcase.

In further non-limiting examples, the extension leg comprises a perimeter sidewall, the adapter plate comprises a perimeter sidewall, and the gearcase comprises an upwardly-facing gearcase housing portion having a perimeter sidewall. The perimeter sidewall of the extension leg is clamped between perimeter sidewall of the adapter plate and the perimeter sidewall of the upwardly-facing gearcase housing.

In further non-limiting examples, an anti-ventilation plate which is sandwiched between the extension leg and the upper opening of the gearcase.

In further non-limiting examples, a motor is in the gearcase, the motor being configured to rotate the propulsor, and the tube provides a passageway for electrical connectors extending into the gearcase for connection to the motor.

In further non-limiting examples, a marine drive comprises a supporting frame for coupling the marine drive to a marine vessel; a gearcase supporting a propulsor for propelling the marine vessel in water; an extension leg disposed between the supporting frame and the gearcase; an adapter plate between the supporting frame and the extension leg; and a tube in the extension leg, the tube having a lower end which is coupled to the gearcase and upper end which is coupled to the adapter plate by a compression nut threaded onto the tube, wherein threading the compression nut down on the tube compressively engages the compression nut with the adapter plate, which in turn clamps the extension leg between the supporting frame and the gearcase.

The above examples are contemplated by the present disclosure in various combinations as further described herein below.

BRIEF DESCRIPTION OF THE DRAWINGS

Examples are described with reference to the following drawing figures. The same numbers are used throughout to reference like features and components.

DETAILED DESCRIPTION

During research and development in the field of marine drives, the present inventors determined it is desirable to reconfigure the lower unit of a marine drive, such as an outboard marine drive, an inboard marine drive, or a stern drive, preferably so as to increase overall load carrying capability, and also preferably so as to avoid the use of externally visible fasteners, thus providing a more durable and visually appealing product. The present disclosure is a result of the present inventors' efforts in this regard.

The invention described herein below has been found to be particularly useful in configurations of marine drives having an electric motor located in a lower gearcase and being configured to power a propulsor, such as one or more propeller(s), impeller(s), and/or the like. The illustrated embodiment is just one example of such a marine drive; however the present invention is not limited for use with the illustrated configuration, and in other examples the present invention can be implemented in differently configured marine drives having an internal combustion engine, a hybrid-electric powerhead, and/or the like. The particular configurations of the marine drive shown and described herein below, including the supporting frame, electric motor, and gearcase, are merely exemplary. The present invention is also useful in conjunction with many other marine drive configurations.

Figure 1:
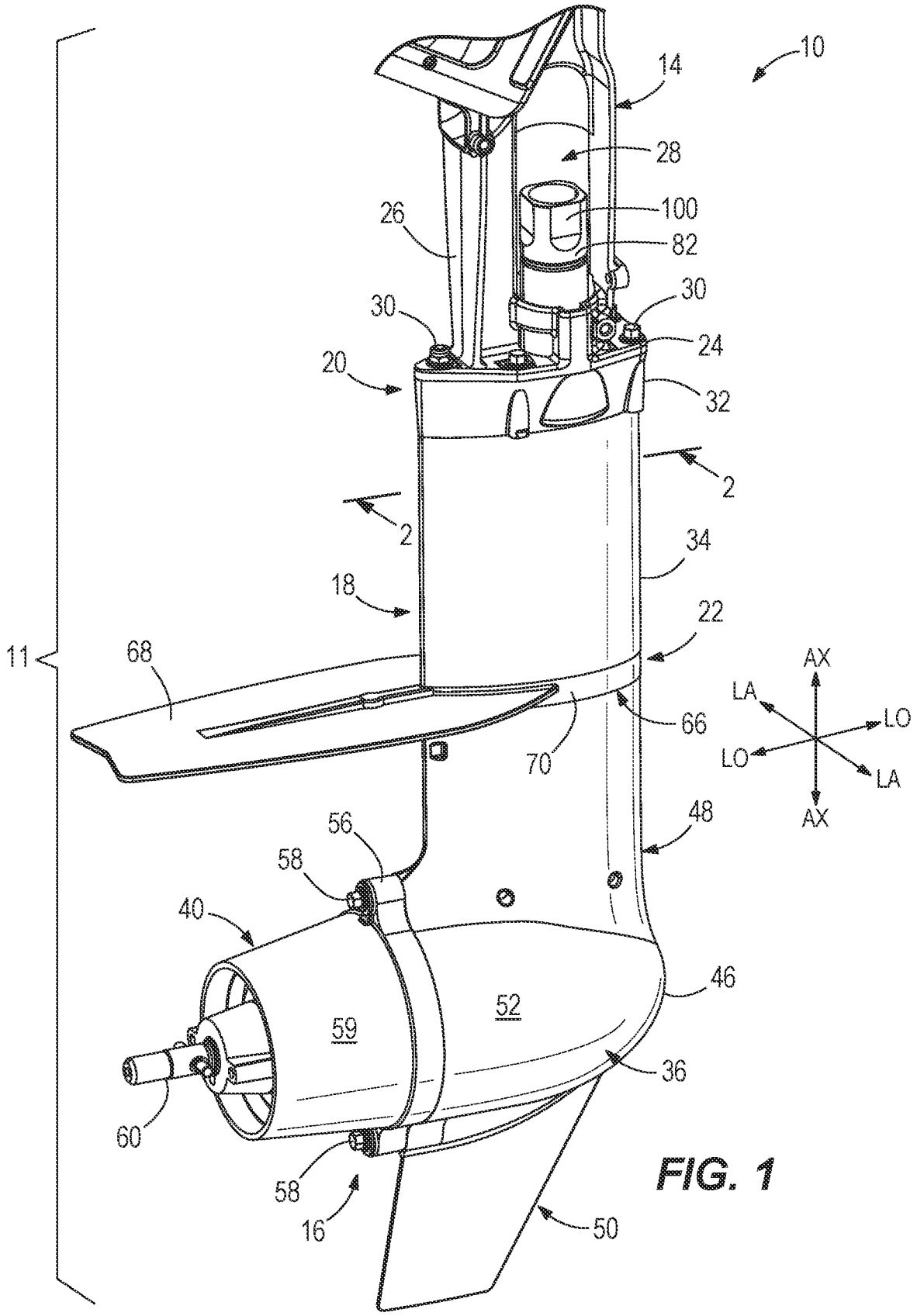
FIG. 1 is a perspective view of a lower unit of a marine drive having an extension leg according to the present disclosure.

FIG. 1 depicts a marine drive 10 for propelling a marine vessel in water. FIG. 1 depicts only lower portions of the marine drive 10. Although not shown, the marine drive 10 also has upper portions, for example one or more upper cowling member(s) which cover an upper supporting frame portion, and/or other conventional apparatuses for supporting various electrical and mechanical components of the marine drive 10. Although not shown, the marine drive 10 is attachable to the marine vessel via for example a conventional transom bracket and/or the like. Some examples of suitable arrangements are provided in the above-incorporated patents, and others are widely commercially available for purchase from Brunswick Corporation and its companies Attwood and Mercury Marine, among others.

In the illustrated embodiment, the marine drive 10 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO.

As shown, the marine drive 10 has a lower unit 11 comprised of a supporting frame 14, a gearcase 16, an extension leg 18 which is located axially between the supporting frame 14 and the gearcase 16, an adapter plate 20 which is located between the extension leg 18 and the supporting frame 14, and an anti-ventilation plate 22 which is located axially between the extension leg 18 and the gearcase 16, and extending rearwardly therefrom.

The upper portions of the supporting frame 14 are not shown in the figures because the type and configuration of the supporting frame 14 can vary. The present invention is not limited for use with a particular type of supporting frame. The supporting frame 14 can be any type of supporting frame known in the art for framing and supporting portions of the marine drive, including being configured to support various components of the marine drive, and/or to couple the marine drive to the marine vessel. Examples of various suitable supporting frames for marine drives are provided in the above-incorporated patents.

Figure 2:
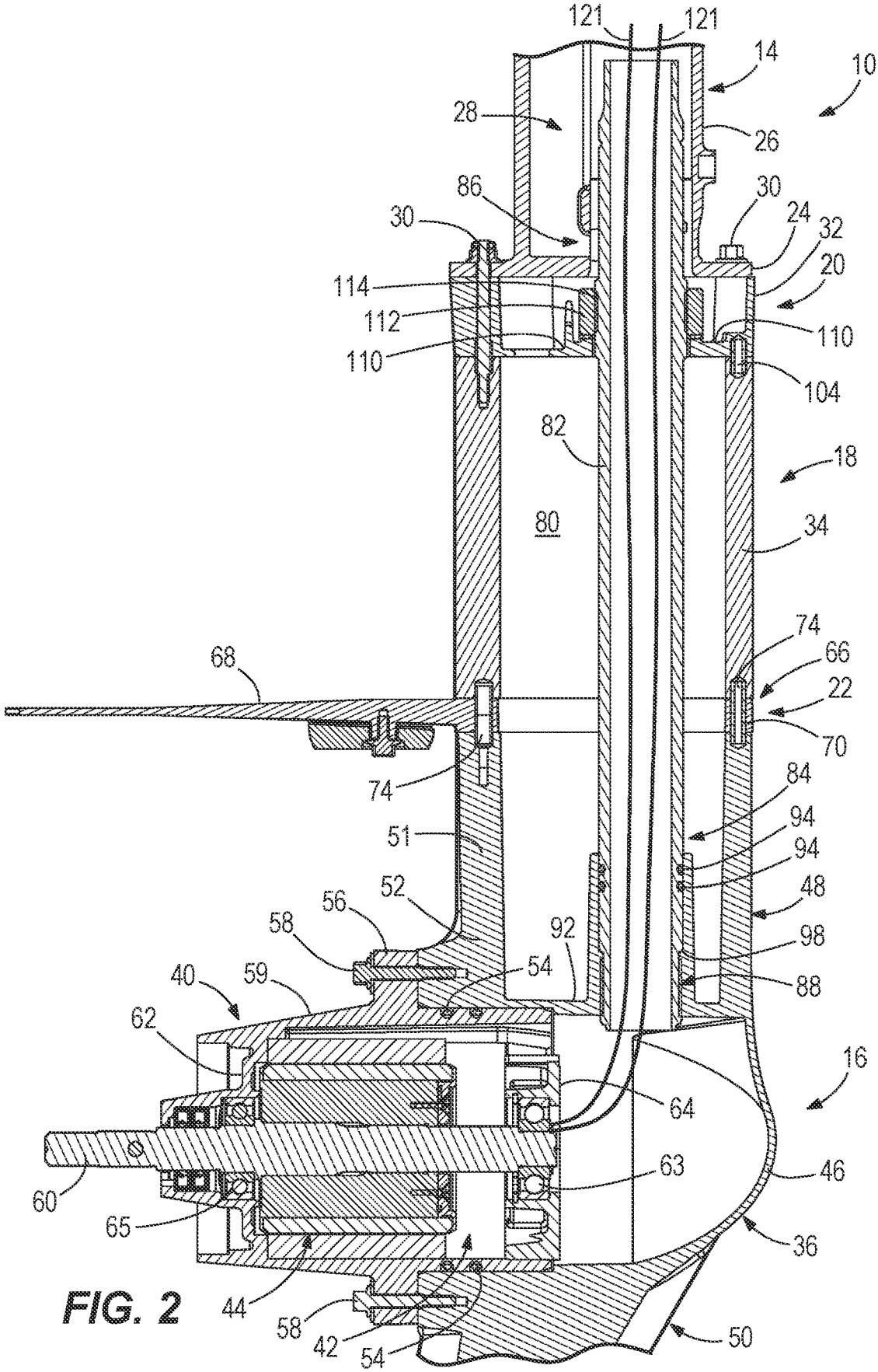
FIG. 2 is a view of section 2-2, taken in FIG. 1.

Referring to FIG. 2, the lower end of the supporting frame 14 has a radial flange 24 which extends from and around the perimeter of the perimeter sidewall 26 of the supporting frame 14. The sidewall 26 of the supporting frame defines an interior passage 28. Fasteners 30 extend through bores in the radial flange 24 and into engagement with bores in the perimeter sidewall 32 of the adapter plate 20. Thus the fasteners 30 fasten the supporting frame 14 to the adapter plate 20.

The gearcase 16 has a front gearcase housing 36 and a rear gearcase housing 40, which together define a gearcase cavity 42 containing an electric motor 44. The front gearcase housing 36 has a nosecone 46 with a smooth outer surface which transitions to an upwardly-facing gearcase housing portion 48 and a downwardly-extending skeg 50. The upwardly-facing gearcase housing portion 48 has a perimeter sidewall 51 which preferably is monolithic so as to avoid visible fasteners or unsightly seams, or can be made of multiple pieces. The nosecone 46 is generally located axially between the upwardly-facing gearcase housing portion 48 and the skeg 50, and protrudes forwardly therefrom. The front gearcase housing 36 further has a rear-facing gearcase housing portion 52 which receives the rear gearcase housing 40 in a nested configuration. O-ring seals 54 are disposed therebetween for limiting water intrusion into the gearcase cavity 42.

The rear gearcase housing 40 has a radially outer flange 56. Fasteners 58 extend through bores in the radially outer flange 56 and into threaded engagement with corresponding bores in the front gearcase housing 36, so as to fasten the rear gearcase housing 40 to the front gearcase housing 36, as shown in a nested arrangement. The rear gearcase housing 40 is generally cylindrical and has a perimeter sidewall 59 which smoothly tapers, radially inwardly at its rear end. The electric motor 44 is also generally cylindrical and is contained within the rear gearcase housing 40, in particular being mounted between a rear end cap 62 and a front end wall 64 of the rear gearcase housing 40. The electric motor 44 causes rotation of an output shaft 60 which longitudinally extends from the rear of the rear gearcase housing 40, through the noted rear end cap 62. The electric motor 44 can be a conventional item, for example an axial flux motor, a radial flux motor, or a transverse flux motor, such as those produced by Electric Torque Machines of Flagstaff, Arizona (a Graco Company). Front and rear bearings 63, 65 support rotation of the output shaft 60 relative to the electric motor 44. A conventional propeller (not shown) is mounted on the outer end of the output shaft 60 such that rotation of the output shaft 60 by the electric motor 44 causes rotation of the propeller, which in turn generates a thrust force for propelling the marine vessel in water.

Figure 3:
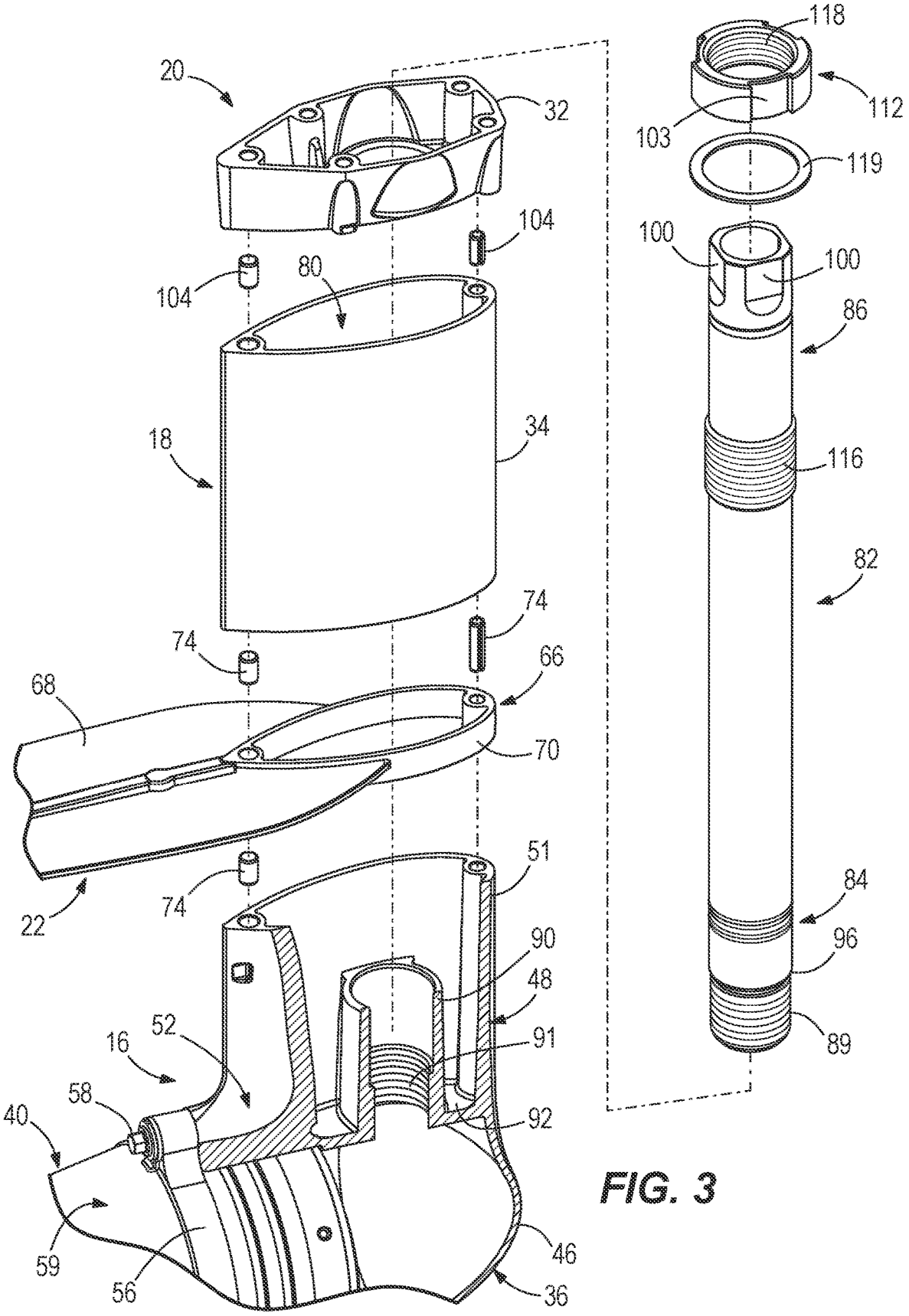
FIG. 3 is an exploded view of the lower unit.
Figure 4:
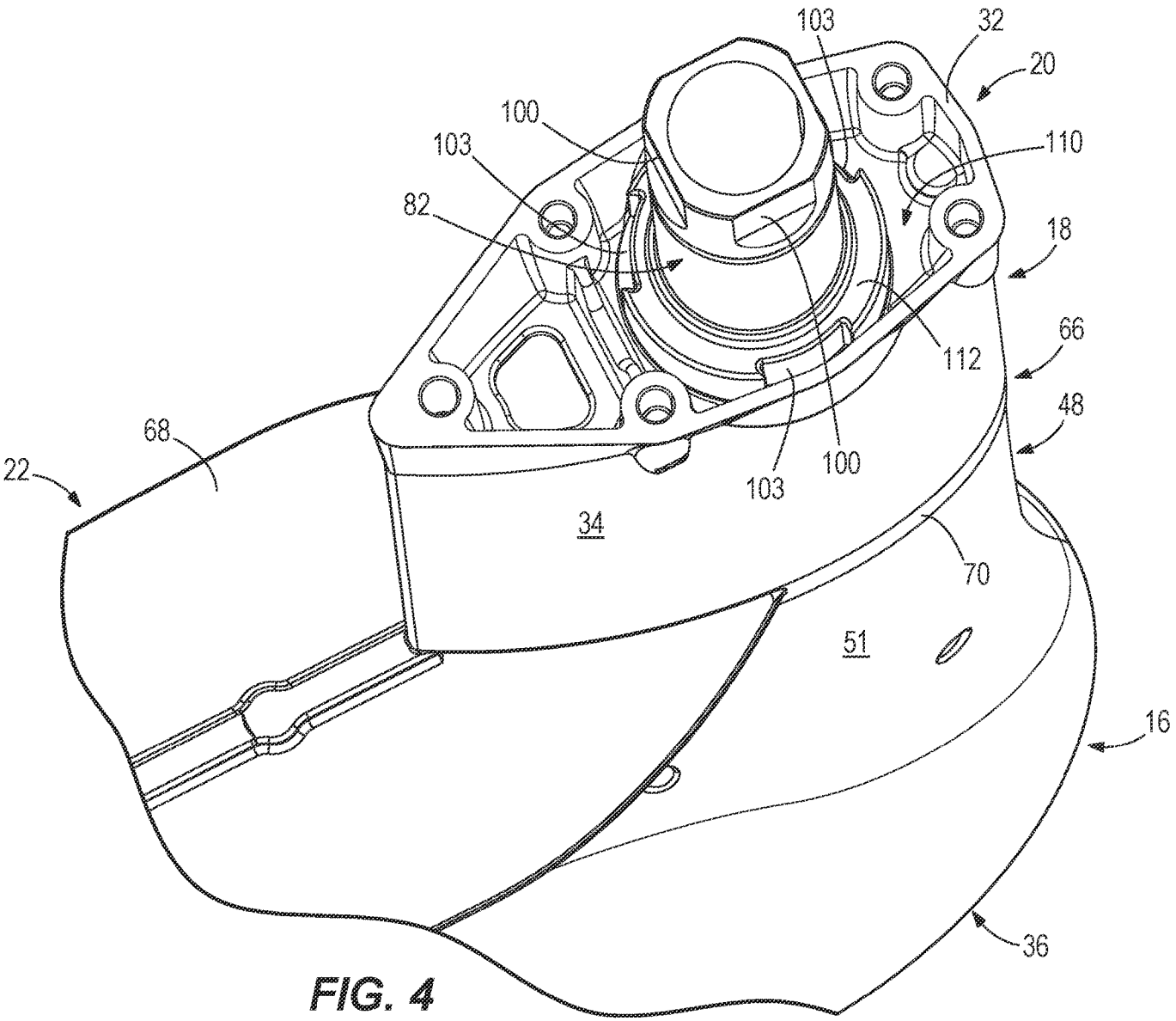
FIG. 4 is a perspective view looking down at the lower unit.
Figure 5:
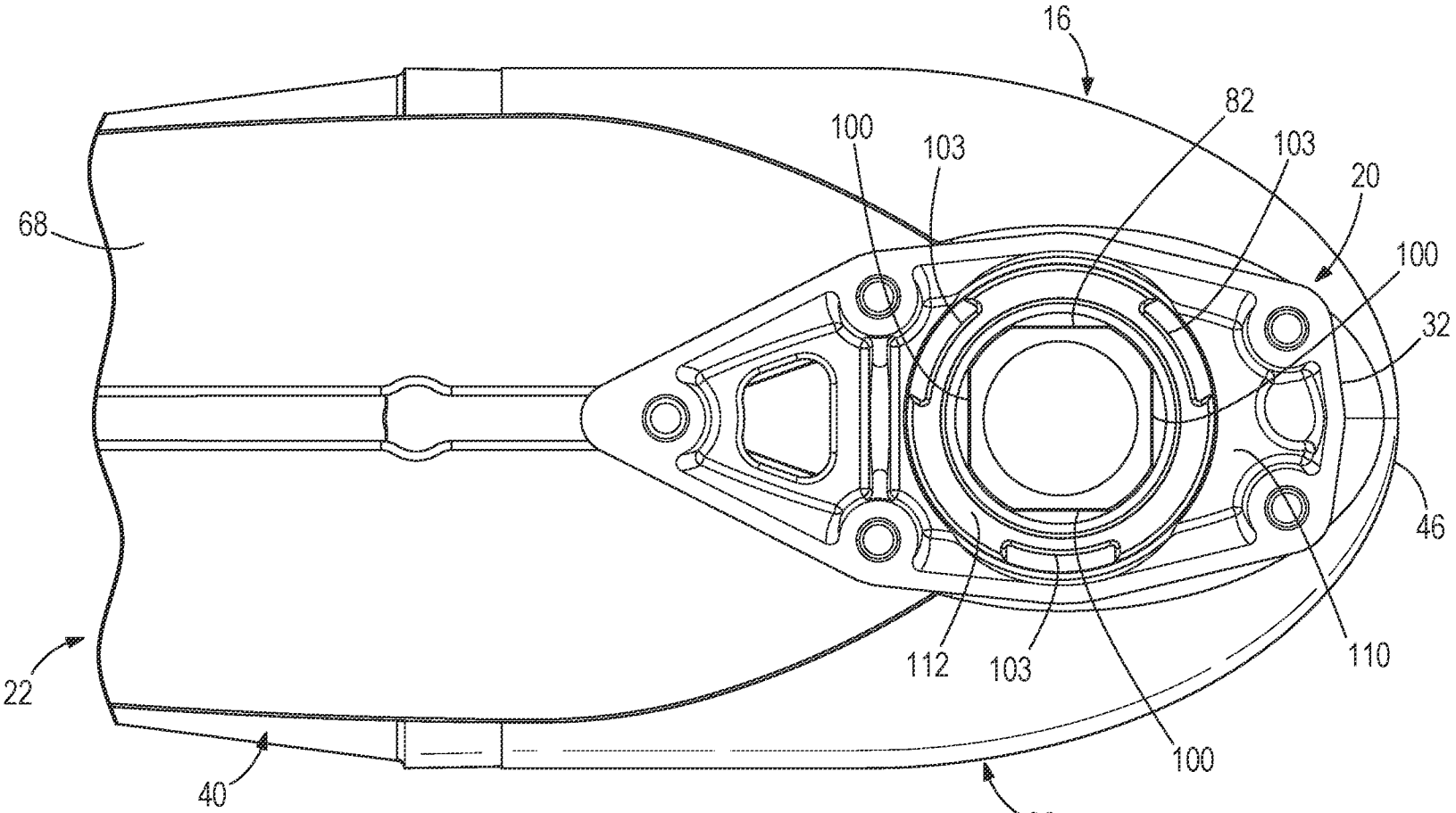
FIG. 5 is a top view of the lower unit.

Referring to FIGS. 2 and 3, the anti-ventilation plate 22 has a head 66 at its forward end which is sandwiched between the extension leg 18 and the upwardly-facing gearcase housing portion 48 of the front gearcase housing 36. The head 66 has a tear-drop shaped perimeter sidewall 70 having a rounded forward end. The perimeter sidewall 70 is preferably monolithic so as to avoid external fasteners or other unsightly seams, or in other examples can be made of multiple pieces. The radially outer profile of the head 66 is foil-shaped or tear-drop shaped and generally matches the radially outer profile of the lower end of the extension leg 18 and also generally matches the radially outer profile of the upper end of the upwardly-facing gearcase housing portion 48, in particular such that these components together provide a smooth outer surface which is streamlined and encounters minimal hydrodynamic drag as the marine vessel travels through the water. Dowel pins 74 register and maintain the head 66 of the anti-ventilation plate 22 in alignment with the upwardly-facing gearcase housing portion 48 and the lower end of the extension leg 18. The dowel pins 74 extend through bores formed through the head 66 of the anti-ventilation plate 22 and into corresponding bores formed in the lower end of the extension leg 18 and corresponding bores the upper end of the upwardly-facing gearcase housing portion 48. The anti-ventilation plate 22 has a generally flat tail 68 which extends rearwardly from the head 66. The tail 68 extends rearwardly from both sides of the head 66.

Referring to FIGS. 2 and 3, the extension leg 18 is a sleeve having the perimeter sidewall 34 which defines a hollow interior 80. The sleeve is preferably monolithic to as to avoid externally visible fasteners or unsightly seam lines, or can be formed from multiple pieces. A hollow, axially-elongated tube 82 is located in the hollow interior 80. The tube 82 has a lower end 84 which is fixedly coupled to the gearcase 16 and an upper end 86 which is coupled to the supporting frame 14 via a compression nut 112, which will be further described herein below. In a non-limiting example, the tube 82 is a monolithic aluminum tube. The hollow interior of the tube 82 provides a passageway for electrical connectors 121 extending from an upper portion of the marine drive 10 to the gearcase cavity 42, and for connection to the electric motor 44, i.e., for providing electricity to the electric motor 44 and/or for controlling the electric motor 44. The lower end 84 of the tube 82 is fixedly or rigidly coupled to the gearcase 16 by a threaded connection 88 comprising outer threads 89 on the outer diameter of the tube 82 and inner threads 91 on the inner diameter of a cylindrical stack 90 extending upwardly from a bottom wall 92 of the upwardly-facing gearcase housing portion 48. O-ring seals 94 provide a water-tight seal between the outer diameter of the tube 82 and the inner diameter of the cylindrical stack 90. A radially outer shoulder 96 on the lower end 84 of the tube 82 bottoms out on a radially inner shoulder 98 in the cylindrical stack 90 when the threaded connection 88 is fully engaged. The outer diameter of the tube 82 at the upper end 86 has flat surfaces 100 for engagement by a manual tool during installation, in particular for rotating the upper end 86 of the tube 82 relative to the gearcase 16 so as to complete the threaded connection 88.

The sidewall 32 of the adapter plate 20 has a radially outer profile that generally matches the radially outer profile of the upper end of the extension leg 18, in particular such that these components together provide a smooth outer surface which is streamlined and provides minimal hydrodynamic drag as the marine vessel travels through the water. Dowel pins 104 register and maintain the adapter plate 20 in alignment with upper end of the extension leg 18. The dowel pins 104 extend into bores formed in the perimeter sidewall of the adapter plate 20 and into corresponding bores formed in the perimeter sidewall of the upper end of the extension leg 18. The adapter plate 20 has an interior abutment surface 110 that laterally and longitudinally extends between the inner diameter of the sidewall 32 of the adapter plate 20. As best seen in FIG. 2, the upper end 86 of the tube 82 axially extends out of the hollow interior 80 of the extension leg 18, through a hole in the interior abutment surface 110, and protrudes the interior passage 28 of the supporting frame 14. The interior abutment surface 110 extends entirely around the tube 82.

The noted compression nut 112 is engaged with the upper end 86 of the tube 82 via a threaded connection 114, and particularly as further explained herein below so as to clamp the extension leg 18 in place between the supporting frame 14 and the gearcase 16, thereby providing increased overall load carrying capability compared to the prior art and avoiding the use of fasteners that are visible from the exterior of the lower unit. The outer diameter of the upper end 86 of the tube 82 has threads 116. The inner diameter of the compression nut 112 has corresponding threads 118 for engaging the threads 116. Flats 103 are disposed around the outer perimeter of the compression nut 112 for engagement by a manual tool for rotating the compression nut 112 about the tube 82.

To assemble the lower unit, a washer 119 and the compression nut 112 are slid onto the upper end 86 of the tube 82 until the threads 118 engage the threads 116. The compression nut 112 is then rotated in the direction that causes the compression nut 112 to travel downwardly along the tube 82, via engagement between the threads 118, 116. Continued rotation of the compression nut 112 moves the compression nut 112 into compressing engagement with the top of the interior abutment surface 110 of the adapter plate 20. Thus, rotation of the compression nut 112 applies a compression force on the adapter plate 20, which in turn pulls the tube 82 and gearcase 16 axially upwardly. This firmly compresses and clamps the head 66 of the anti-ventilation plate 22 and the extension leg 18 between the gearcase 16 and bottom of the adapter plate 20 without the need for external fasteners and in an improved load-bearing arrangement. Advantageously the entire arrangement can be easily assembled in an efficient manner.

It will thus be understood that the present disclosure provides improved embodiments of marine drives comprising a supporting frame for coupling the marine drive to a marine vessel; a gearcase supporting a propulsor for propelling the marine vessel in water; an extension leg disposed between the supporting frame and the gearcase; and a tube in the extension leg, the tube having an upper end and a lower end, wherein the lower end is rigidly coupled to the gearcase. A compression nut advantageously directly or indirectly couples the upper end of the tube to the supporting frame, in particular so as to clamp the extension leg in place between the supporting frame and the gearcase. The compression nut is engaged with the tube by a threaded connection such that rotating the compression nut relative to the tube in a first direction causes the compression nut to travel downwardly along the tube and such that rotating the compression nut relative to the tube in an opposite, second direction causes the compression nut to travel upwardly along the tube. An adapter plate is located between the supporting frame and the extension leg. The tube extends through the adapter plate. Rotating the compression nut relative to the tube in the first direction moves the compression nut into compressing engagement with the adapter plate, which in turn clamps the extension leg between the adapter plate and the gearcase. Rotating the compression nut relative to the tube in the second direction moves the compression nut out of compressing engagement with the adapter plate, which in turn unclamps the extension leg relative to the adapter plate and the gearcase.

The adapter plate comprises an abutment surface disposed around the tube, wherein rotating the compression nut relative to the tube in the first direction moves the compression nut onto the abutment surface, which thereby clamps the extension leg between the adapter plate and the gearcase. The extension leg comprises a perimeter sidewall, the adapter plate comprises a perimeter sidewall, and the gearcase comprises an upwardly-facing gearcase housing portion having a perimeter sidewall. The perimeter sidewall of the extension leg is clamped between perimeter sidewall of the adapter plate and the perimeter sidewall of the upwardly-facing gearcase housing. Preferably the respective sidewalls are monolithic sleeves that do not have externally visible fasteners or seams, thus providing an aesthetically pleasing appearance in a hydrodynamically effective package that is easy to assemble, and which also has improved load-bearing stability over other embodiments in the prior art.

An anti-ventilation plate is sandwiched between the extension leg and the upper opening of the gearcase. A motor in the gearcase, the motor being configured to rotate the propulsor. The tube provides a passageway for electrical connectors extending into the gearcase for connection to the motor. The lower end of the tube is fixed to the gearcase by a threaded connection comprising outer threads on the tube and inner threads on the gearcase.

In certain examples, the extension leg is a monolithic sleeve and the tube in the extension leg is a monolithic aluminum tube.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A marine drive comprising:

a supporting frame for coupling the marine drive to a marine vessel;

a gearcase configured for supporting a propulsor for propelling the marine vessel in water;

an extension leg disposed between the supporting frame and the gearcase;

an adapter plate between the supporting frame and the extension leg;

a tube in the extension leg, the tube having an upper end and a lower end, wherein the lower end is rigidly coupled to the gearcase; and a compression nut which directly or indirectly couples the upper end of the tube to the supporting frame, in particular so as to clamp the extension leg in place between the supporting frame and the gearcase;

wherein the extension leg comprises a perimeter sidewall, the adapter plate comprises a perimeter sidewall, and the gearcase comprises an upwardly-facing gearcase housing portion having a perimeter sidewall, and wherein the perimeter sidewall of the extension leg is clamped between perimeter sidewall of the adapter plate and the perimeter sidewall of the upwardly-facing gearcase housing portion;

wherein a radially outer profile of the lower end of the extension leg generally matches a radially outer profile of an upper end of the upwardly-facing gearcase housing portion, and a radially outer profile of the upper end of the extension leg generally matches a radially outer profile of the perimeter sidewall of the adapter plate, such that the extension leg, the upwardly-facing gearcase housing portion, and the adapter plate together provide a smooth outer surface which is streamlined for minimizing hydrodynamic drag as the marine vessel travels through the water.

2. The marine drive according to claim 1, wherein the compression nut is engaged with the tube by a threaded connection such that rotating the compression nut relative to the tube in a first direction causes the compression nut to travel downwardly along the tube and such that rotating the compression nut relative to the tube in an opposite, second direction causes the compression nut to travel upwardly along the tube.

3. The marine drive according to claim 2, wherein the tube extends through the adapter plate, and wherein rotating the compression nut relative to the tube in the first direction moves the compression nut into compressing engagement with the adapter plate, which in turn clamps the extension leg between the adapter plate and the gearcase.

4. The marine drive according to claim 3, wherein rotating the compression nut relative to the tube in the second direction moves the compression nut out of compressing engagement with the adapter plate, which in turn unclamps the extension leg relative to the adapter plate and the gearcase.

5. The marine drive according to claim 3, wherein the adapter plate is fastened to the supporting frame, optionally wherein the adapter plate is fastened to a radial flange of the supporting frame.

6. The marine drive according to claim 3, wherein the adapter plate comprises an abutment surface disposed around the tube, wherein rotating the compression nut relative to the tube in the first direction moves the compression nut onto the abutment surface, which thereby clamps the extension leg between the adapter plate and the gearcase.

7. The marine drive according to claim 1, further comprising an anti-ventilation plate which is sandwiched between the extension leg and an upper opening of the gearcase.

8. The marine drive according to claim 7, wherein the anti-ventilation plate comprises a head having a radially outer profile that generally matches the radially outer profile of the lower end of the extension leg and also generally matches the radially outer profile of the upper end of the upwardly-facing gearcase housing portion, in particular such as these components together provide the smooth outer surface which is streamlined and encounters minimal hydrodynamic drag as the marine vessel travels through the water.

9. The marine drive according to claim 1, further comprising a motor in the gearcase, the motor being configured to rotate the propulsor, optionally wherein the tube provides a passageway for electrical connectors extending into the gearcase for connection to the motor.

10. The marine drive according to claim 1, wherein the lower end of the tube is fixed to the gearcase by a threaded connection, optionally wherein the threaded connection comprises outer threads on the tube and inner threads on the gearcase, optionally wherein the upper end of the tube has an outer diameter with flat surfaces for engagement by a tool for rotating the upper end of the tube into engagement with the gearcase.

11. The marine drive according to claim 1, wherein the extension leg is a monolithic sleeve.

12. The marine drive according to claim 1, wherein the tube is a monolithic aluminum tube.

13. The marine drive according to claim 1, wherein the upper end of the tube is coupled to the adapter plate by the compression nut threaded onto the tube, and wherein threading the compression nut down on the tube compressively engages the compression nut with the adapter plate, which in turn clamps the extension leg between the supporting frame and the gearcase.

14. The marine drive according to claim 13, further comprising a motor in the gearcase, the motor being configured to rotate the propulsor, wherein the tube is hollow and thus provides a passageway for electrical connectors for providing power to the motor.

15. The marine drive according to claim 13, further comprising threads on an outer diameter of the tube which are engaged by corresponding threads on an inner diameter of the compression nut, wherein rotating the compression nut relative to the tube causes the compression nut to travel downwardly along the tube via engagement between the threads on the outer diameter of the tube and the threads on the inner diameter of the compression nut.

16. The marine drive according to claim 13, wherein the adapter plate is fastened to the supporting frame.

* * * * *